US012677952B2

(12) United States Patent
Brekke et al.

(10) Patent No.: US 12,677,952 B2
(45) Date of Patent: Jul. 14, 2026

(54) SEAT BACK FOR AN OFFICE CHAIR

(71) Applicant: Haworth, Inc., Holland, MI (US)

(72) Inventors: Craig Brekke, Rockford, MI (US); William Reck, Holland, MI (US); Jacob Cammenga, Hudsonville, MI (US); Weston Boerckel, Hudsonville, MI (US); Andras Kupfermann, Grand Rapids, MI (US); Angelina Lullie, Chicago, IL (US); Mark J. Sherman, Zeeland, MI (US)

(73) Assignee: Haworth, Inc., Holland, MI (US)

( * ) Notice: Subject to any disclaimer, the term of this patent is extended or adjusted under 35 U.S.C. 154(b) by 201 days.

(21) Appl. No.: 18/417,096

(22) Filed: Jan. 19, 2024

(65) Prior Publication Data

US 2025/0235004 A1 Jul. 24, 2025

(51) Int. Cl.
*A47C 7/46* (2006.01)
*A47C 7/54* (2006.01)

(52) U.S. Cl.
CPC ..... *A47C 7/462* (2013.01); *A47C 7/46* (2013.01); *A47C 7/541* (2018.08)

(58) Field of Classification Search
CPC ..... A47C 7/46; A47C 7/541; A47C 7/462
See application file for complete search history.

(56) References Cited

U.S. PATENT DOCUMENTS 4,516,305 A 5/1985 Unger
5,871,258 A * 2/1999 Battey ..... A47C 1/03274 297/312
5,909,923 A * 6/1999 DeKraker ..... A47C 1/03255 297/285
5,975,634 A * 11/1999 Knoblock ..... A47C 7/14 297/284.7
5,979,984 A * 11/1999 DeKraker ..... A47C 1/03274 297/303.4
6,086,153 A * 7/2000 Heidmann ..... A47C 1/03233 297/303.3

(Continued)

FOREIGN PATENT DOCUMENTS

CN 1615769 A * 5/2005 ..... A47C 7/46
CN 111248678 A * 6/2020 ..... A47C 7/46

(Continued)

*Primary Examiner* — Rodney B White
(74) *Attorney, Agent, or Firm* — Warner Norcross + Judd LLP

(57) ABSTRACT

A seat back for an office chair is efficiently manufactured and assembled. The seat back includes a tensioner for tensioning a flexible support on the structural frame. The tensioner is connected between the lower edge of the flexible support and the upright members of the frame such that the tensioner stretches the flexible support between the upper and lower edges of the flexible support and maintains the flexible support in tension on the structural frame. An armrest mount may be formed integrally with each of the upright members of the structural frame, and an armrest housing vertically adjustably mounted to each of the armrest mounts. An activation mechanism is positioned adjacent to the lower end of the armrest housing, and is connected to a lock element such that movement of the activation mechanism toward the upper end of the housing causes the lock element to move to an unlocked position.

20 Claims, 19 Drawing Sheets

(56) References Cited

U.S. PATENT DOCUMENTS 6,116,695 A * 9/2000 Heidmann ..... A47C 1/023 297/285
6,220,661 B1 * 4/2001 Peterson ..... A47C 7/46 297/226
6,318,800 B1 * 11/2001 DeKraker ..... A47C 1/03274 297/300.2
6,349,992 B1 * 2/2002 Knoblock ..... A47C 7/46 297/284.7
6,367,877 B1 * 4/2002 Knoblock ..... A47C 1/03233 297/301.1
6,382,719 B1 * 5/2002 Heidmann ..... A47C 7/46 297/284.4
6,386,636 B2 * 5/2002 Caruso ..... A47C 1/03277 297/411.36
6,394,545 B2 * 5/2002 Knoblock ..... A47C 1/03255 297/284.7
6,394,546 B1 * 5/2002 Knoblock ..... A47C 7/14 297/284.7
6,394,548 B1 * 5/2002 Battey ..... A47C 1/03238 297/303.4
6,394,549 B1 * 5/2002 DeKraker ..... A47C 1/03233 297/317
6,460,928 B2 * 10/2002 Knoblock ..... A47C 7/14 297/284.4
6,471,294 B1 * 10/2002 Dammermann ..... A47C 31/023 297/284.7
6,508,509 B2 * 1/2003 Peterson ..... A47C 7/24 297/226
6,575,530 B1 * 6/2003 Fischer ..... A47C 7/462 297/284.7
6,623,078 B2 * 9/2003 Chu ..... A47C 7/54 297/411.36
6,672,669 B2 * 1/2004 Chu ..... A47C 1/03 297/411.36 X
6,688,698 B1 * 2/2004 Chou ..... A47C 1/03 297/411.36
6,709,058 B1 * 3/2004 Diffrient ..... A47C 31/126 297/316
6,733,080 B2 * 5/2004 Stumpf ..... B29C 45/14631 297/452.56
6,749,261 B2 * 6/2004 Knoblock ..... A47C 1/03233 297/284.4
6,817,668 B2 * 11/2004 DeKraker ..... A47C 7/445 297/300.8
6,824,218 B1 11/2004 van Hekken
6,840,582 B2 1/2005 Burwell et al.
6,896,333 B1 5/2005 Matern et al.
6,905,171 B2 * 6/2005 Knoblock ..... A47C 1/03255 297/300.1
6,957,861 B1 * 10/2005 Chou ..... A47C 3/18 297/452.64
6,974,189 B2 12/2005 Machael et al.
7,011,371 B1 3/2006 Tsai
7,040,709 B2 * 5/2006 Knoblock ..... A47C 1/023 297/452.36
7,040,711 B2 * 5/2006 DeKraker ..... A47C 7/24 297/463.1
7,055,911 B2 6/2006 Simpson et al.
7,097,247 B2 * 8/2006 Battey ..... A47C 1/03255 297/284.7
7,097,254 B2 8/2006 Hobb et al.
7,114,777 B2 * 10/2006 Knoblock ..... A47C 1/03255 297/284.4
7,131,700 B2 * 11/2006 Knoblock ..... A47C 1/023 297/284.4 X
7,201,450 B1 4/2007 Chen
7,234,777 B2 * 6/2007 Schweikarth ..... A47C 7/402 297/411.36
7,341,313 B2 3/2008 Bedford et al.
7,344,194 B2 * 3/2008 Maier ..... A47C 7/46 297/284.7
7,427,105 B2 * 9/2008 Knoblock ..... A47C 1/03233 297/284.4
7,661,763 B2 2/2010 Tsai
7,712,834 B2 * 5/2010 Knoblock ..... A47C 1/03274 297/284.4
7,770,979 B2 8/2010 He
7,832,805 B1 11/2010 Lai
7,841,665 B2 11/2010 Geister et al.
7,980,632 B2 7/2011 Pai
8,016,360 B2 9/2011 Machael et al.
8,282,170 B2 10/2012 Lai
8,403,417 B2 3/2013 Huang
8,777,318 B2 7/2014 Chen
8,888,183 B2 * 11/2014 Parker ..... A47C 7/14 297/316
8,967,724 B2 3/2015 Battey et al.
9,004,603 B1 4/2015 Wang
9,084,487 B1 7/2015 Su
9,155,393 B2 * 10/2015 Hurford ..... A47C 7/46
9,345,333 B2 5/2016 Gorgi
9,578,971 B2 2/2017 Su
9,700,139 B2 7/2017 Su
9,795,220 B1 10/2017 Chen
9,861,205 B2 1/2018 Hector et al.
9,872,565 B2 1/2018 Battey et al.
9,901,175 B2 2/2018 Chen
10,130,186 B2 * 11/2018 Tong ..... A47C 7/54
10,165,864 B1 1/2019 Su
10,264,890 B2 * 4/2019 Aldrich ..... A47C 7/462
10,299,595 B2 * 5/2019 Diffrient ..... A47C 3/026
10,376,067 B2 * 8/2019 Aldrich ..... A47C 5/02
10,413,072 B2 9/2019 Bock
10,463,153 B2 * 11/2019 Peterson ..... A47C 31/023
10,537,176 B2 1/2020 Bock
10,660,445 B2 5/2020 Fang
10,667,616 B1 6/2020 Lai et al.
10,813,459 B2 * 10/2020 Peterson ..... A47C 1/023
10,813,463 B2 * 10/2020 Deevers ..... A47C 7/46
11,089,876 B2 8/2021 Chen
11,191,360 B2 12/2021 Hsieh
11,291,305 B2 * 4/2022 Deevers ..... A47C 7/40
11,344,128 B2 5/2022 Chen et al.
11,439,239 B2 * 9/2022 Masunaga ..... A47C 7/40
11,583,082 B2 * 2/2023 Peterson ..... A47C 1/03274
11,583,092 B2 * 2/2023 Deevers ..... A47C 7/44
11,819,139 B2 * 11/2023 Deevers ..... A47C 7/40
12,004,660 B2 * 6/2024 Deevers ..... A47C 7/46
12,433,414 B2 * 10/2025 Zhang ..... A47C 7/541
2012/0175933 A1 * 7/2012 Tsai ..... A47C 1/03 297/411.36
2014/0097658 A1 * 4/2014 Chen ..... A47C 1/03 297/411.2 X
2019/0029427 A1 1/2019 Eysing
2022/0007841 A1 1/2022 Chen et al.
2022/0175142 A1 * 6/2022 Zhou ..... A47C 1/0305

FOREIGN PATENT DOCUMENTS

CN 115553598 A 1/2023
DE 202004011519 U1 * 11/2004 ..... A47C 7/402
EP 1192881 A2 4/2002
KR 102012277 B1 * 8/2019 ..... A47C 7/46
KR 102506195 B1 * 3/2023 ..... A47C 7/46
KR 102574254 B1 * 9/2023 ..... A47C 7/46
KR 20240157261 A * 11/2024 ..... A47C 31/006
WO 2008064673 A1 6/2008
WO WO-2013065816 A1 * 5/2013 ..... A47C 7/46
WO WO-2017213251 A1 * 12/2017 ..... A47C 7/462
WO 2022018645 1/2022

* cited by examiner

SEAT BACK FOR AN OFFICE CHAIR

BACKGROUND OF THE INVENTION

The present invention is directed to office chairs, and, more particularly, to a seat back for an office chair.

In the competitive market for office seating, users demand office seating options that provide comfort, function, and a high degree of adjustability, but these chairs must also be cost effective to purchase and manufacture. As a result, office chair manufacturers are continually searching for improved methods of manufacturing office chairs and office chair components.

Some office chair manufacturers have increased efficiency in manufacture by reducing or simplifying components such as the back support or the mechanism. For example, some modern office chairs have moved to a one-piece seat back, often molded unitarily to form a plastic shell, thus reducing the number of seat back components from multiple elements requiring assembly to a single element that can simply be attached to the office chair base. Other office chairs have reduced the size of the chair mechanism, typically a series of controls and springs, and the number of spring elements within the mechanism in order to simplify the assembly process and reduce weight. Still others are eliminating features, such as certain seat adjustments, or features such as lumbar support or armrests.

Each of the above noted efforts in efficiency, however, have drawbacks, including aesthetic challenges, the reduction of comfort and adjustment features. As a result, manufacturers continue to search for efficiencies that may minimize these and other drawbacks.

SUMMARY OF THE INVENTION

The present invention provides a seat back for an office chair that can be efficiently manufactured and assembled. In one embodiment, the seat back includes a structural frame having a pair of spaced apart upright members each having an upper end and a lower end, a lower cross member connecting the lower ends of the uprights, and an upper cross member connecting the upper ends of the uprights, and a flexible support including a user support surface having an upper edge, a lower edge, and a pair of side edges, the upper edge of the flexible support mounted on the upper cross member of the frame.

The seat back may include a tensioner for tensioning the flexible support on the structural frame. In one embodiment, the tensioner is connected between the lower edge of the flexible support and the upright members of the frame such that the tensioner stretches the flexible support between the upper and lower edges of the flexible support and maintains the flexible support in tension on the structural frame. The upright members may each include a tensioner mount, and the tensioner may be connected between the lower edge of the flexible support and the tensioner mount. The tensioner may include a base and a pair of arms extending from the base, the base extending along the lower edge of the flexible support, the arms each extending along one of the side edges of the flexible support. The tensioner arms may each be connected to an associated one of the tensioner mounts such that the tensioner can be engaged with the tensioner mounts and pivoted to stretch the flexible support on the structural frame.

In another embodiment, the seat back includes an armrest mount formed integrally with each of the upright members of the structural frame, and an armrest housing vertically adjustable mounted to each of the armrest mounts. A lock mechanism within the housing may include a lock element that is movable between a locked position in which the housing is fixed in position on the armrest mount and an unlocked position in which the housing is vertically adjustable along the armrest mount. An activation mechanism is positioned adjacent to the lower end of the armrest housing, and is connected to the lock element such that movement of the activation mechanism toward the upper end of the housing causes the lock element to move to the unlocked position. In one embodiment, the armrest mount includes a pair of rails, and one of the rails may define a plurality of vertically spaced notches, with the lock element positioned in one of the notches when the lock element is in the locked position.

The present invention further includes a method for constructing a seat back. The method including the steps of: providing a flexible support including a user support surface having an upper edge, a lower edge, and a pair of side edges; providing a structural frame having a pair of spaced apart upright members each having an upper end and a lower end, a lower cross member connecting the lower ends of the uprights, and an upper cross member connecting the upper ends of the uprights; providing a tensioner arm having a first and a second end; attaching the first end of the tensioner arm to the lower edge of the flexible support; mounting the upper edge of the flexible support to the upper cross member of the structural frame; engaging the second end of the tensioner arm with one of the upright members of the structural frame; and pivoting the tensioner arm about the second end of the tensioner arm to draw the first end of the tensioner arm to the structural frame as the tensioner arm acts to stretch the flexible support between the upper and lower edges of the flexible support.

In one embodiment, the method may additionally include integrally forming armrest mounts with the upright members of the structural frame, and providing a pair of armrest housings, each housing associated with one of the armrest mounts. The armrest housings may slidably attach to the armrest mounts, and may be selectively vertically adjustable along the armrest mounts. The operation of the armrests may include vertically depressing a button plate on the armrest housing to activate an activation mechanism for locking and unlocking the adjustability of the armrest.

DESCRIPTION OF THE CURRENT EMBODIMENTS

Figure 1:
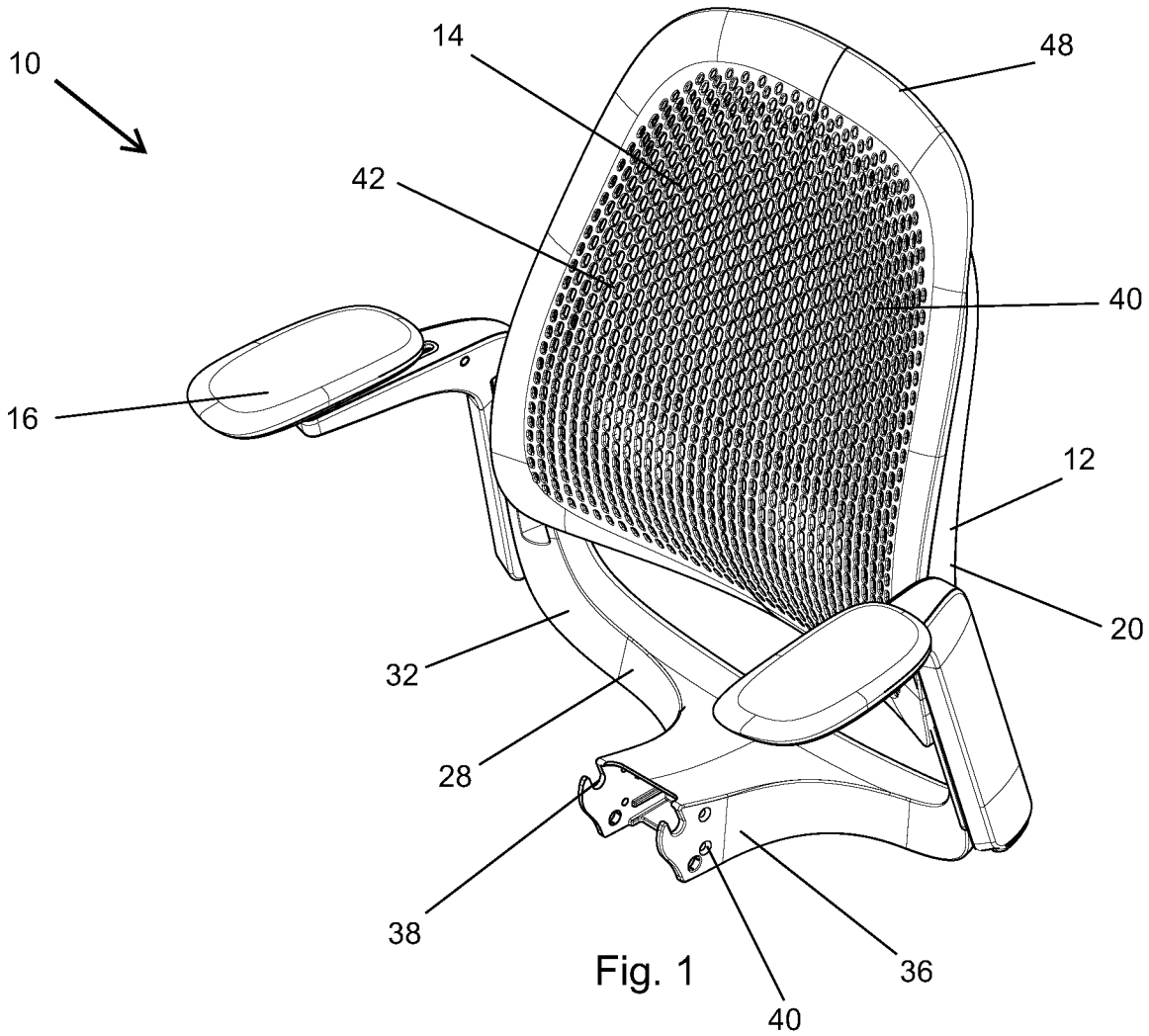
FIG. 1 is a perspective view of a seat back according to one embodiment of the present invention.

A seat back for an office chair according to one embodiment of the present invention is shown in FIG. 1 and generally designated 10. The seat back 10 generally includes a structural frame 12, a flexible support material 14 supported on the frame 12, and a pair of armrests 16 mounted directly on the structural frame 12. Although not shown, the seat back 10 is designed to be supported above a ground surface by a conventional office chair base, which may include a height adjustable pedestal supported on a plurality of feet that may optionally include casters.

The structural frame 12 and a system for mounting the flexible support material 14 in tension on the structural frame using a tensioner 18 is shown in FIGS. 1-9. The frame 12 is generally a rigid, structural support frame 12 for attaching to the chair base and supporting the back of a user sitting on a seat that is also supported on the chair base adjacent to the seat back 10 in a conventional manner. The frame 12 may be molded from a rigid plastic, or may be constructed of another structural material. In one embodiment, the frame 12 is a perimeter frame that includes a pair of spaced apart uprights 20 having lower ends 22 and upper ends 24. The uprights 20 may be connected by an upper cross member 26 at their upper ends 24, and may be connected by a lower cross member 28 at their lower ends 22. The frame 12 may have a forward surface 32 facing the direction of a user, a rear surface 34 opposite the forward surface, an external surface 35, and an internal surface 37. As shown, the frame members collectively define a central opening 30. In one embodiment, the frame 12 includes an attachment portion 36 extending from the front surface 32 of the lower cross member 26. Although a variety of attachment mechanisms are possible for connecting the seat back 10 to a chair base, the illustrated embodiment shows an attachment portion 36 that includes a notch 38 for receiving a portion of the chair base, and a series of attachment holes 40 for securing the seat back 10 to the chair base. The frame 12 may additionally include a tensioner mount 41 for engaging the tensioner 18 as discussed in more detail below to enable using the tensioner 18 to stretch the flexible support onto the frame 12. In one embodiment, shown in FIG. 6, the frame 12 includes a series of support ribs 43 on the rear surface 34, and the tensioner mount 41 includes a pair of windows 45 formed in the support ribs 43, with one window 45 within a support rib 43 on a first one of the uprights 20 and the other within a support rib 43 on the other of the uprights 20. The windows 45 may each be positioned at the same height on the uprights 20, between the upper 24 and lower 22 ends of the uprights 20. In one embodiment, the windows 45 are positioned at about a midpoint between the upper 24 and lower 22 ends of the uprights. In another embodiment, the windows 45 may be positioned at a different height on the uprights 20.

Figure 2:
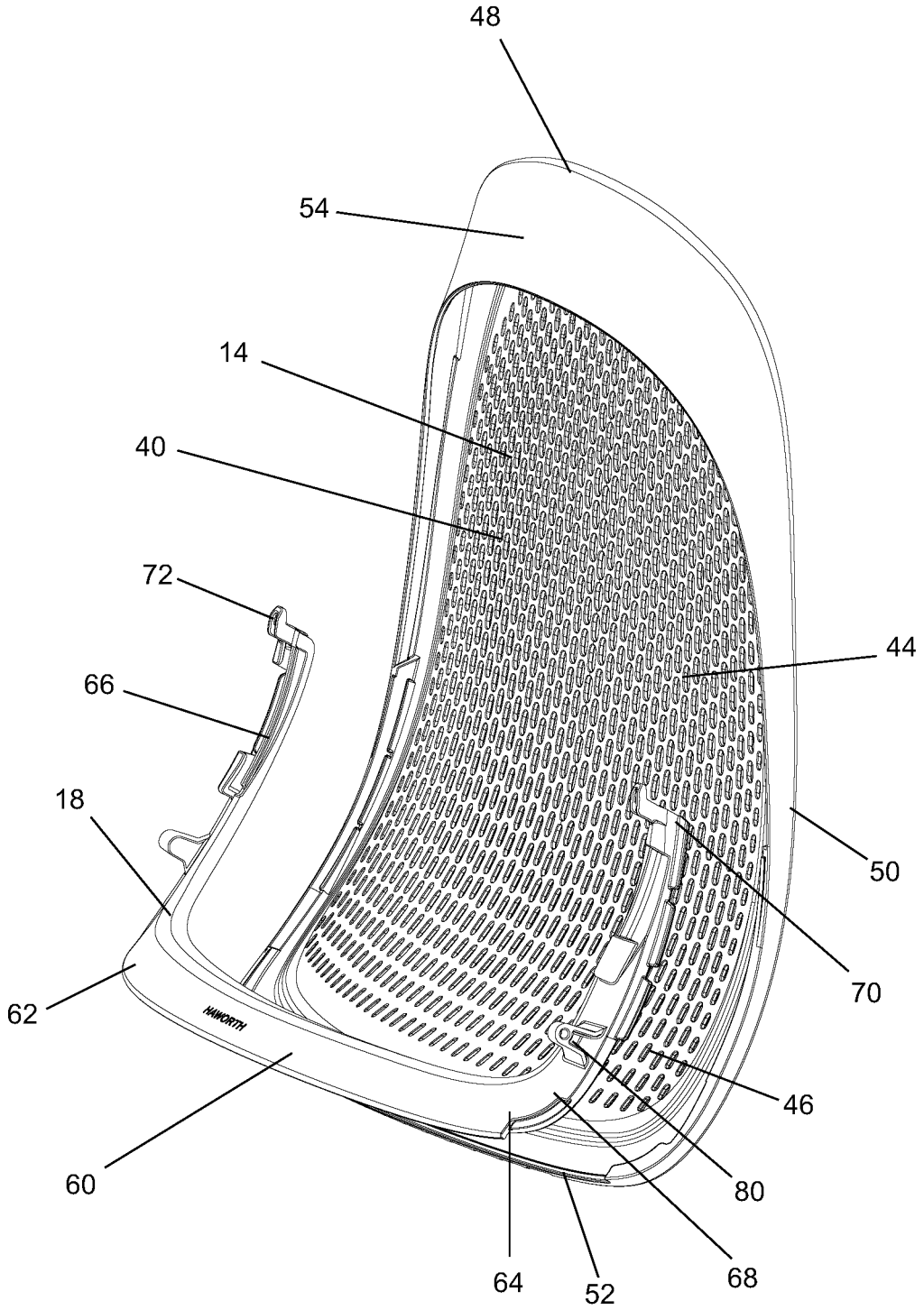
FIG. 2 is a rear exploded view of a tensioner and flexible support.

The flexible support 14 attaches to the structural frame 12 to extend over the central opening 30 and form a comfortable back support surface for the user. In one embodiment, the flexible support 14 is formed from a flexible thermoplastic elastomer, and in a more specific embodiment is formed from the thermoplastic polyester elastomer known as Hytrel® and manufactured by DuPont™. Other flexible materials, including knit or woven fabrics, and elastomeric fabrics, may also be used. The flexible support 14 may be manufactured by a variety of methods, an in one embodiment is injection molded as a single, unitary piece. With reference to FIGS. 1 and 2, the flexible support 14 includes a central section 40 having a forward, user facing surface 42 and an opposite, rear facing surface 44. As illustrated, the central section 40 includes a series of perforations 46 that may add both aesthetic value and comfort to the flexible support 14. The flexible support 14 further includes an upper edge 48, a pair of lateral side edges 50, and a bottom edge 52. The edges 48, 50, 52 may be formed with a greater thickness than the central section 40 to provide the perimeter of the flexible support 14 with increased strength. In one embodiment, the upper edge 48 is formed to include a pocket 54 extending from the rear surface 44 of the flexible support 14.

Figure 8:
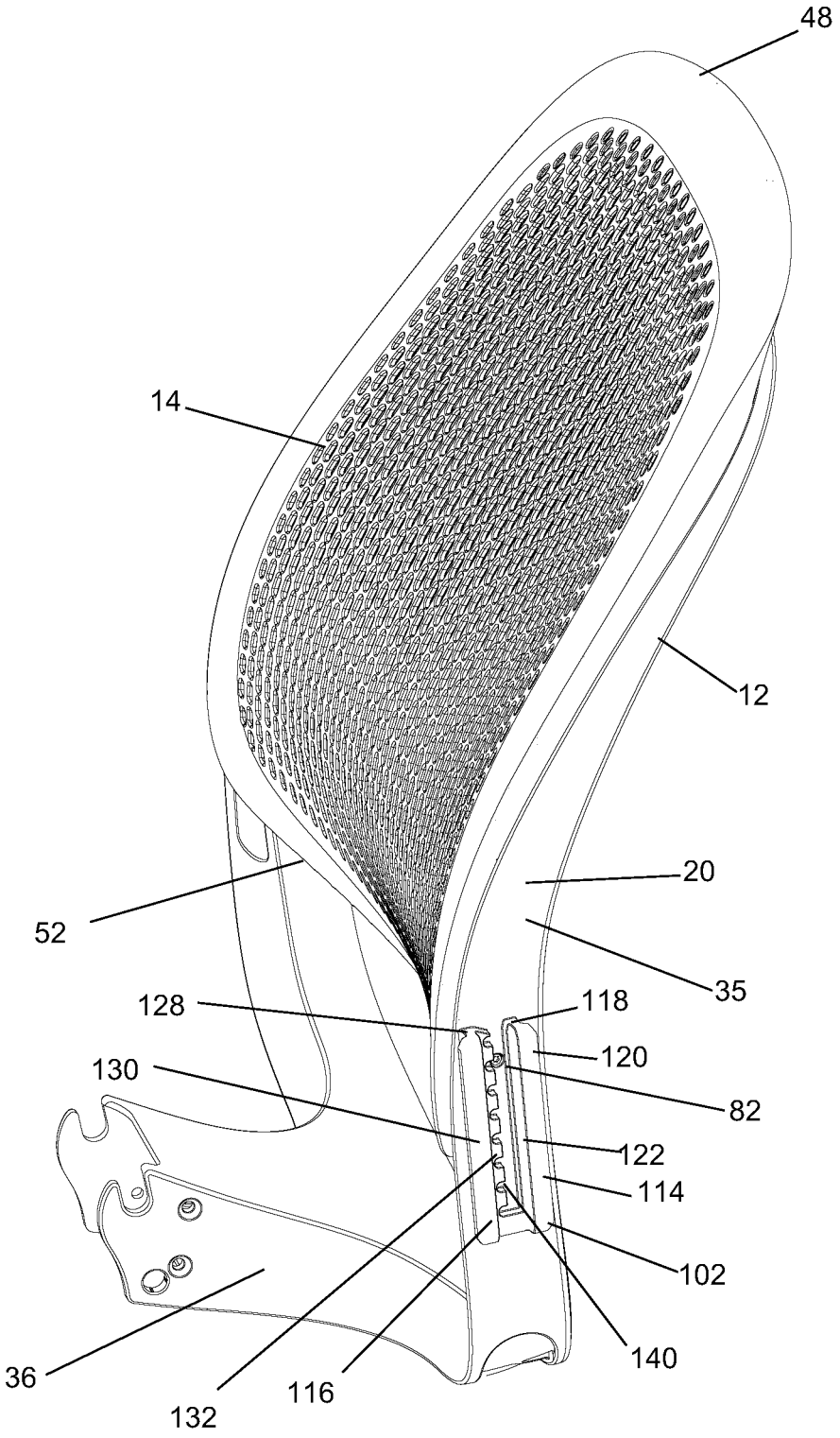
FIG. 8 is a front perspective view of a flexible support attached to a support frame.
Figure 9:
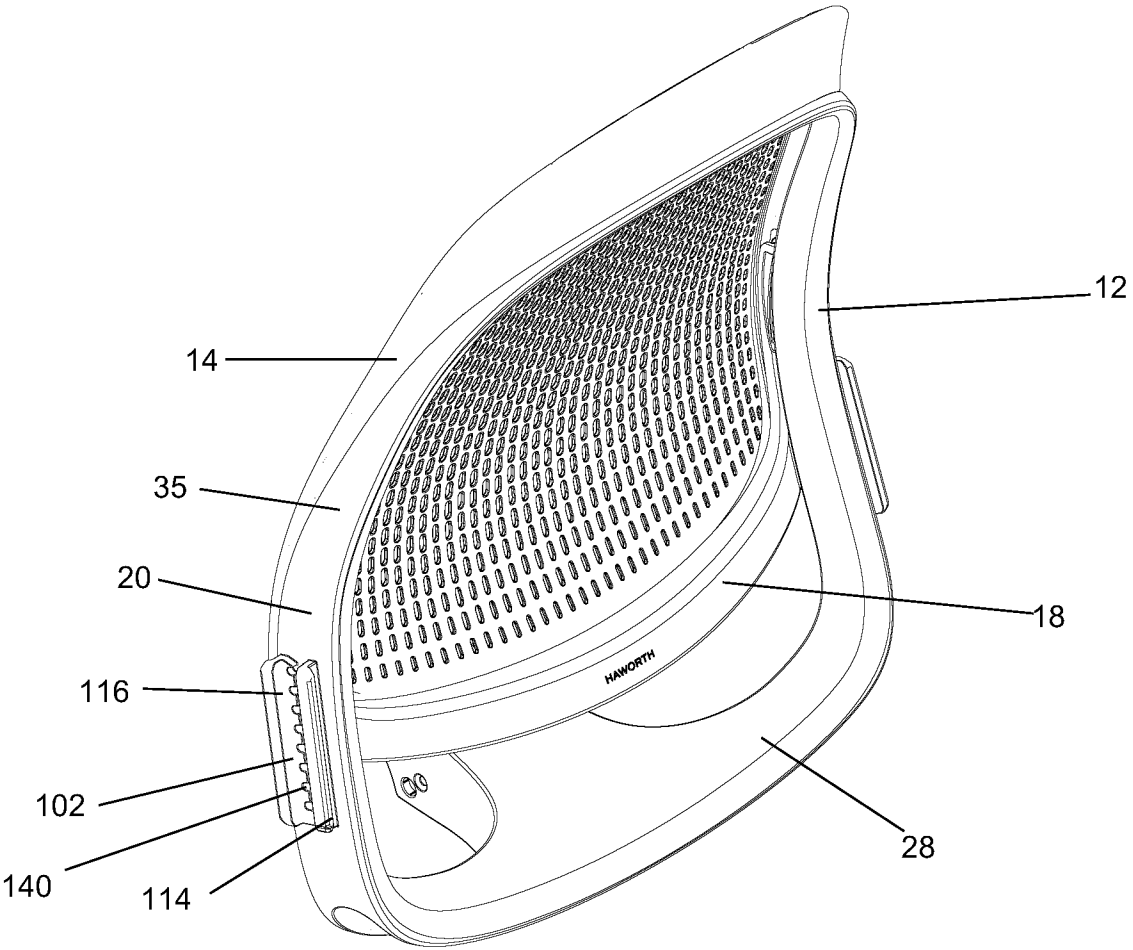
FIG. 9 is a rear perspective view thereof.

In one embodiment, the flexible support 14 is mounted in tension on the structural frame by the tensioner 18, which can enable efficient assembly of the flexible support 14 in tension on the frame 12 with minimal separate fasteners and tools. As described in more detail below, the tensioner 18 attaches to the flexible support 14, and installs the flexible support 14 onto the frame 12 by inserting a portion of the upper cross member 26 of the frame 12 into the pocket 54 on the flexible support 14, engaging the tensioner 18 with the frame 12 in a first position as shown in FIGS. 4-7, and then pivoting to a second, installed position on the frame 12 as shown in FIGS. 8-9, wherein the tensioner 18 acts to stretch the flexible support 14 as the tensioner 18 is pivoted from the first position to the installed position. As shown in FIG. 2, the tensioner 18 of the illustrated embodiment is formed from a generally rigid material, such as the same polymer as the frame 12, or a different structural polymer or other material. In one embodiment, the tensioner 18 is a U-shaped member having a base 60 with a first end 62 and a second end 64, and a pair of arms 66 extending from the base 60 at the opposite ends 62, 64. The arms 66 may extend parallel or generally parallel to each other, and each have a base end 68 at the base 60 and a pivot end 70 distal from the base 60. In the illustrated embodiment, the tensioner base 60 defines a length between the first 62 and second 64 ends that is approximately the same as the length of the bottom edge 52 of the flexible support 14. The tensioner 18 attaches to the rear surface 44 of the flexible support 14, and in illustrated embodiment the tensioner 18 is attached to the rear surface 44 of the bottom edge 52 of the flexible support 14 by a conventional attachment method, such as a series of lugs, fasteners, heat stakes, sonic welding, overmolding or other locking features. The entire tensioner 18 may be attached to the flexible support 14, although in one embodiment, the tensioner arms 66 are not attached to the flexible support 14 such that the tensioner arms 66 are free to pivot away from the flexible support 14.

The tensioner arms 66 each include structure that enables the arms 66 to pivotally engage with the tensioner mounts 41 on the uprights 20. As noted above, in the illustrated embodiment, the tensioner mounts 41 are windows 45 formed in the support ribs 43 of the uprights 20. In one embodiment, the tensioner arms 66 may each include a hook 72 extending from the pivot ends 70 of the tensioner arms 66. As shown in FIG. 6, the hooks 72 face the rear surface 34 of the frame 12, and each hook 72 is capable of interfitting with one of the windows 45 when the flexible support 14 is attached to the frame 12. Notably, the length of the tensioner arms 66 is predetermined to provide the flexible support 14 with a desired amount of tension when the hooks 72 are hooked to the tensioner mounts 41 and the arms 66 are positioned against the rear surface 34 of the frame 12 in the installed position. For example, the length of the tensioner arms 66 is such that the distance between the upper 48 and lower 52 edges of the flexible support 14 is stretched when the flexible support 14 is attached to the tensioner 18 and the tensioner is in its installed position on the frame 12 as shown in FIG. 8. Put another way, the flexible support 14 may have a first, unstretched length between the upper 48 and lower 52 edges when the flexible support 14 is in the first position shown in FIGS. 4-7, and a second, stretched length that is greater than the first length when the tensioner 18 is attached to the flexible support 14 and the tensioner 18 is attached to the frame 12 in the installed position with the tensioner arms abutting the rear surface 34 of the frame 12.

In one embodiment, the tensioner arms 66 additionally include structure for fastening the tensioner 18 to the frame 12 when the tensioner 18 is in the installed position. With reference to FIGS. 2-7, the tensioner 18 includes a screw boss 80 on each of the tensioner arms 66. As shown, the screw bosses 80 are positioned about at a midpoint along the arms 66, although the position on the arms 66 may be varied as desired. With reference to FIG. 8, the frame 12 defines a tensioner hole 82 in each of the uprights 20. The tensioner holes 82 each align with one of the screw bosses 80 when the tensioner 18 is in the installed position, such that conventional fasteners (not shown) can be inserted through each upright 20 and the tensioner 18 to hold the tensioner 18 in the installed position. In an alternative embodiment, the tensioner 18 and frame 12 may be provided with features that enable the tensioner 18 to snap fit with the frame 12 when the tensioner 18 is moved to the installed position.

Figure 3:
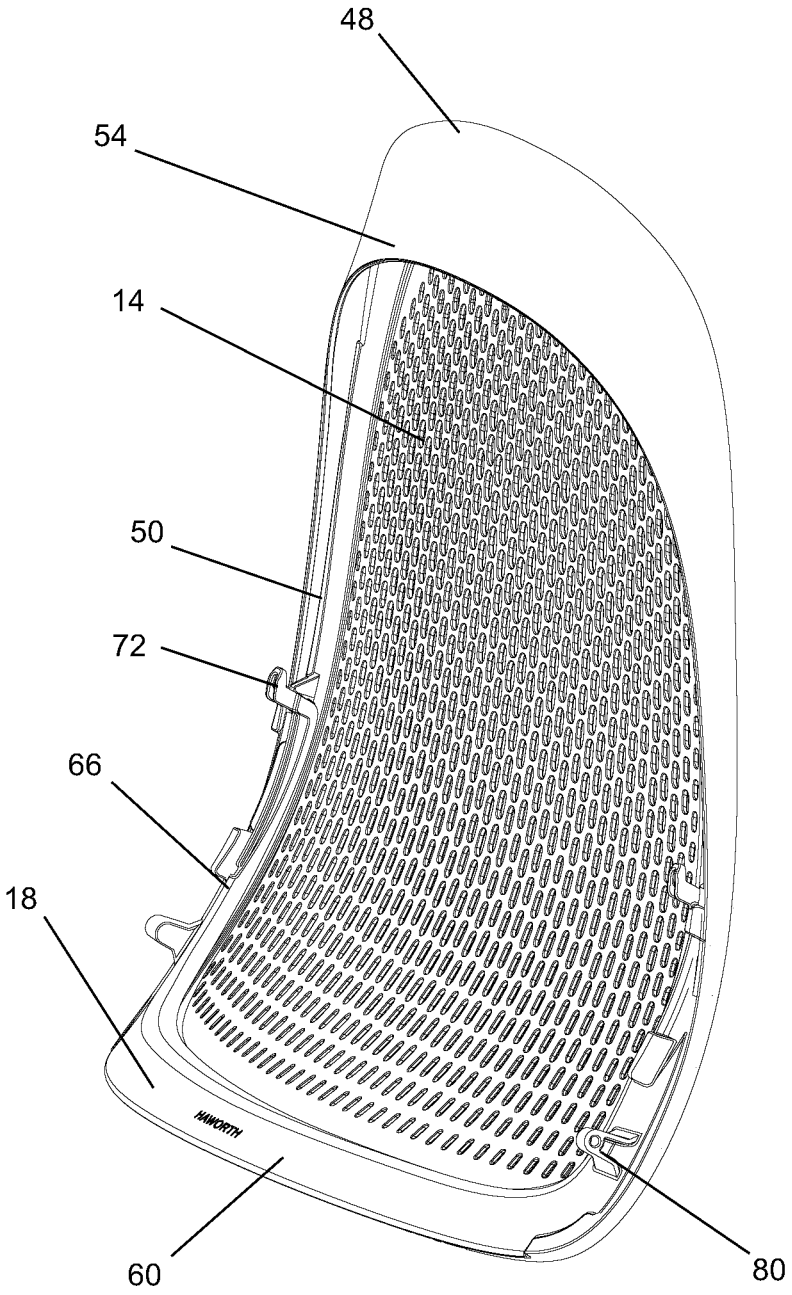
FIG. 3 is a rear view of the tensioner and flexible support.
Figure 4:
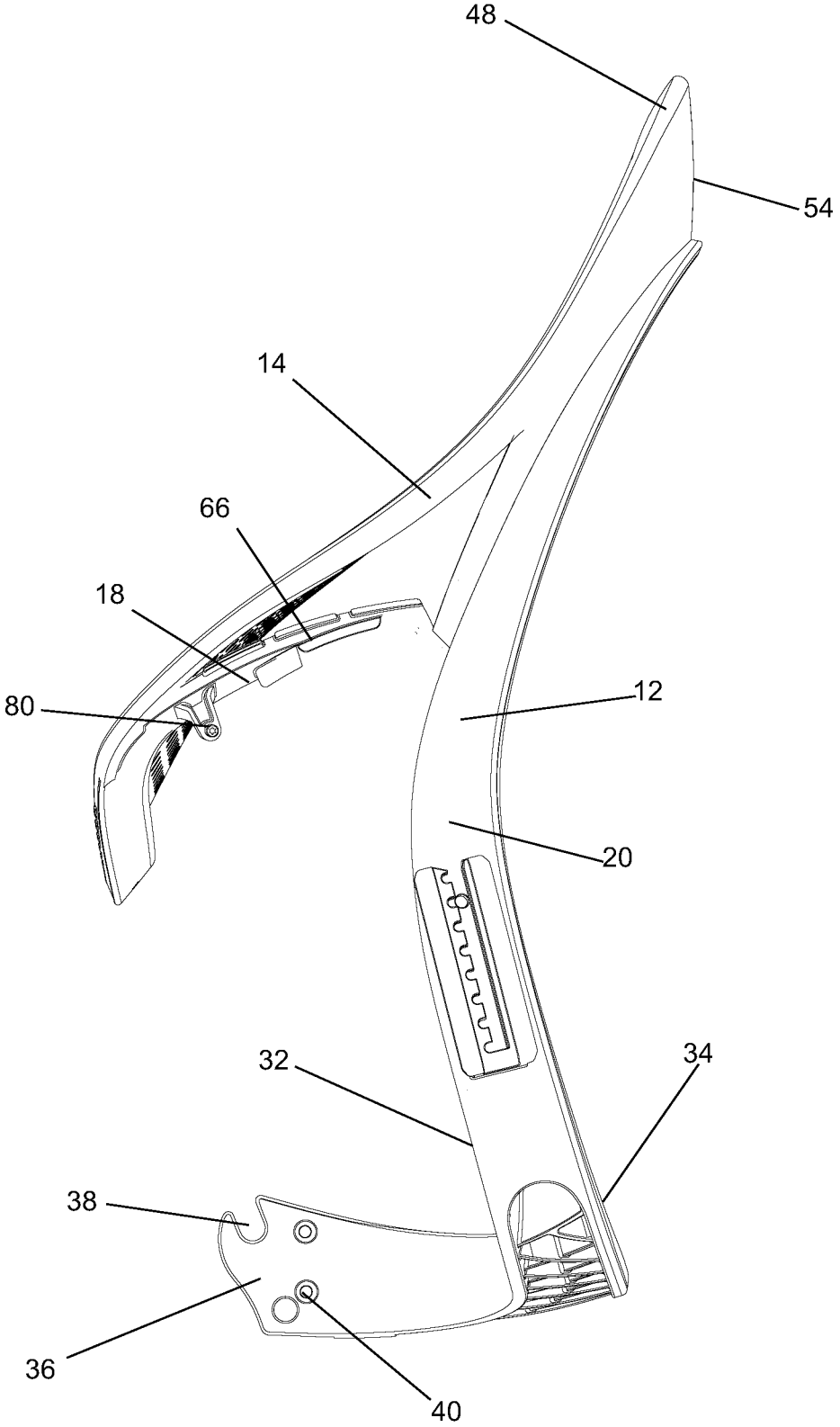
FIG. 4 is a side view of the tensioner and flexible support partially attached to a support frame.

The process for attaching the flexible support 14 to the structural frame 12 is shown in FIGS. 2-9. FIG. 2 shows the flexible support 14 prior to its attachment to the tensioner 18 or frame 12, with the tensioner 18 shown in exploded view. In this embodiment, the flexible support 14 and the tensioner 18 have been separately formed, each as a single piece. The flexible support 14 is formed by molding a flexible material, such as a thermoplastic elastomer, to the desired form and the tensioner 18 is formed by molding a rigid plastic into the U-shaped form, although the flexible material could otherwise be a knit or woven fabric with elastomeric or other resilient properties. FIG. 3 shows the tensioner 18 attached to the flexible support 14 along the bottom edge 52 of the flexible support 14 with the tensioner base 60 extending along the bottom edge 52 from side edge 50 to side edge 50 of the flexible support 14. As noted, the tensioner base 60 may be attached to the bottom edge 52 by a conventional method. With the base 60 attached to the bottom edge 52, the tensioner arms 66 each extend upwardly along one of the side edges 50, and the hooks 72 extend rearwardly from the tensioner arms 66 away from the flexible support 14.

The assembled flexible support 14 and tensioner 18 are then attached to the structural frame 12. In one embodiment, this is initiated by inserting a portion of the upper cross member 26 of the frame 12 into the pocket 54 of the flexible support 14, as shown in FIGS. 4-7. The hooks 72 of the tensioner 18 are then inserted into the tensioner mount windows 45 on the frame 12 with the tensioner arms 66 extending at an angle away from the uprights 20 as also shown in FIG. 6. From this position, the tensioner arms 66 are pivoted about the hooks 72, moving the base 60 of the tensioner 18 in an arcuate path until the tensioner 18 abuts the rear surface 34 of the frame 12, resulting with the tensioner 18 in the installed position shown in FIG. 8. Notably, as the tensioner 18 is pivoted to the installed position, the flexible support 14 is stretched by the tensioner 18 from an unstretched state to a stretched, tensioned state. The stretching may primarily occur in the vertical direction (i.e., the upper edge 48 and the bottom edge 52 are stretched away from each other), but may also occur in the lateral direction from side edge 50 to side edge 50 depending on the respective orientation of the tensioner arms 66 with respect to the tensioner base 60. In one embodiment, the stretching of the flexible support 14 is enhanced by the concave curvature of the forward surface 32 of the structural frame 12 as the flexible support 14 is caused to stretch around the curved front surface 32. In the installed position shown in FIG. 8, the screw bosses 80 on the tensioner 18 align with the tensioner holes 82 in the frame 12 and fasteners are driven through the holes 82 and into the screw bosses 80 to hold the tensioner 18 and flexible support 14 in place.

With reference to FIGS. 10-20, the seat back 10 may additionally include an armrest system 100 attached to or formed integrally with the seat back 10. In one embodiment, the armrest system 100 includes an armrest mount 102 formed integrally with the structural frame 12, and an armrest housing 104 that adjustably attaches to the armrest mount 102. The armrest housing 104 includes an upper end 106 and a lower end 108, the upper end 106 supports an armrest pad 110, and the lower end 108 includes an actuation mechanism 112 for selectively locking and unlocking the adjustability of the armrest housing 104 on the armrest mount 102.

Figure 5:
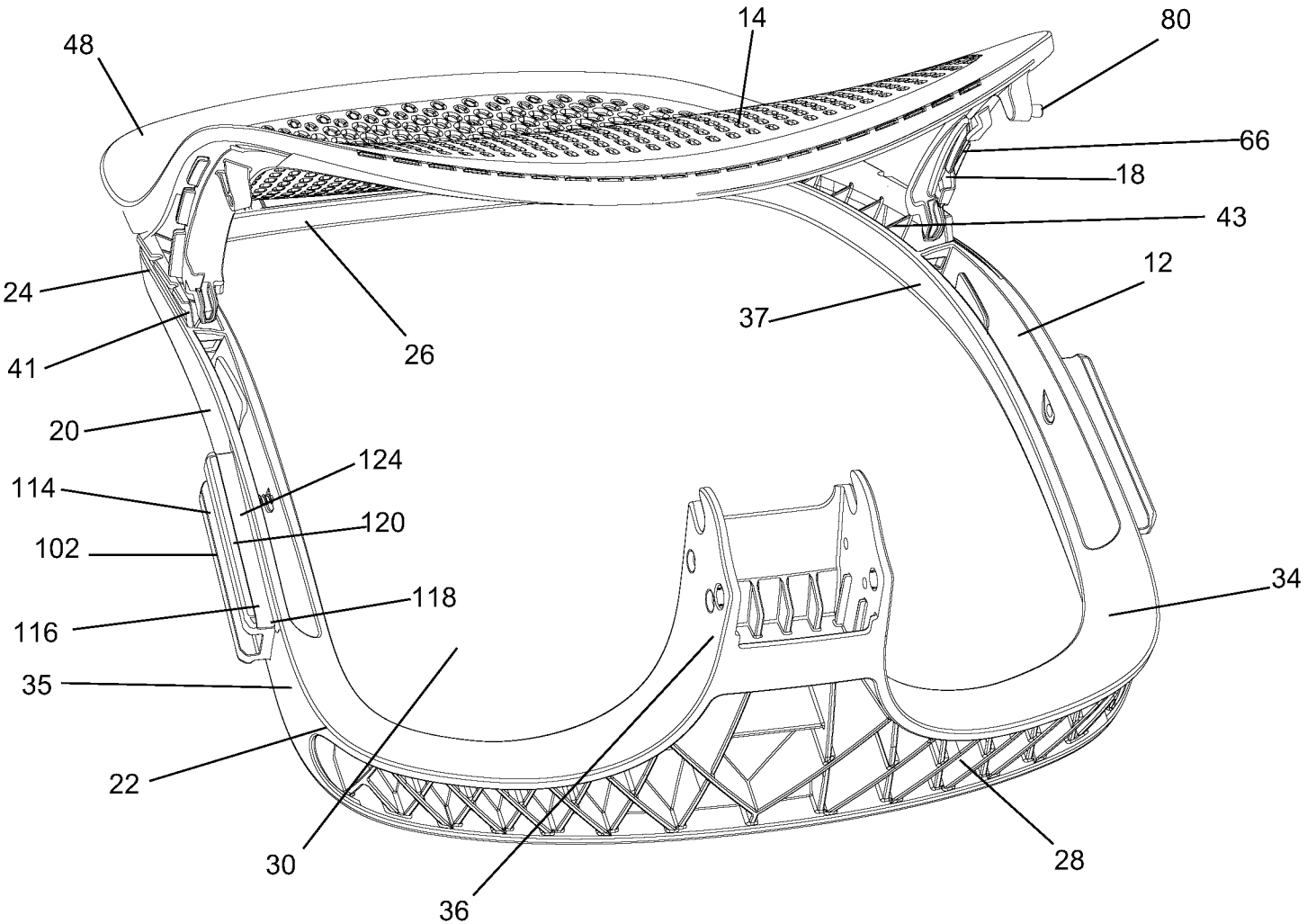
FIG. 5 is a bottom view thereof.
Figure 6:
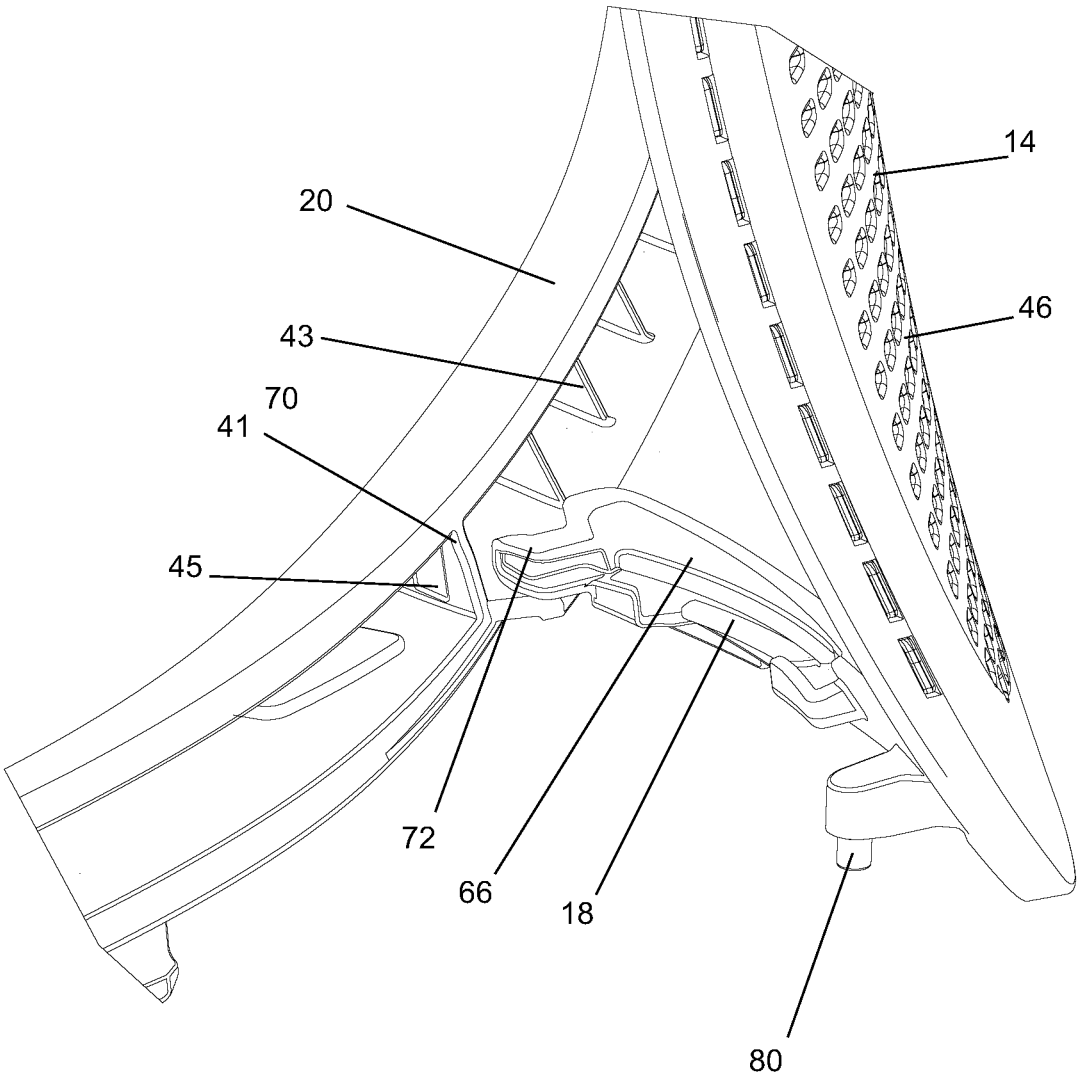
FIG. 6 is a close up view of the tensioner mount.
Figure 7:
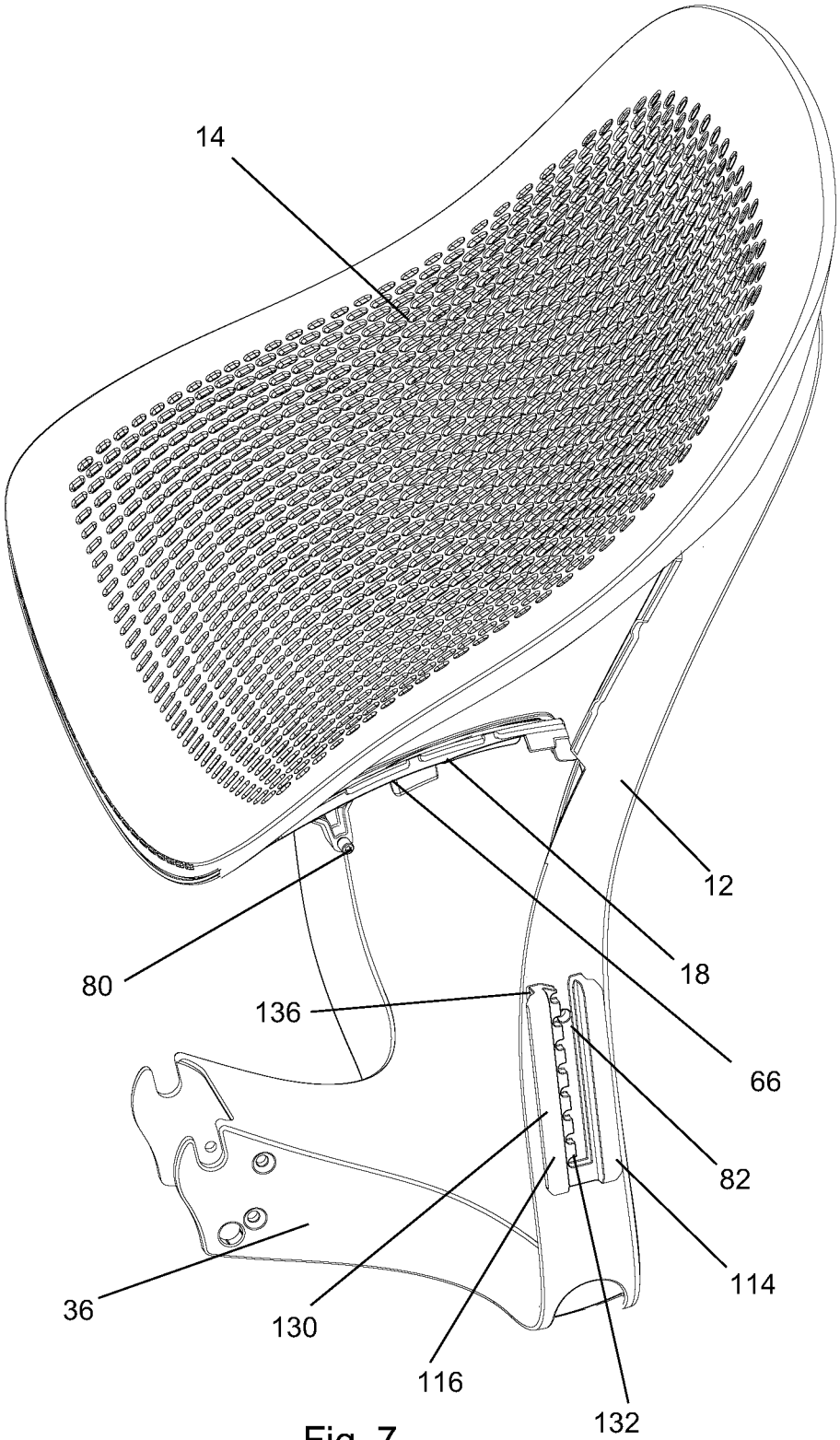
FIG. 7 is a front perspective view of the tensioner and flexible support partially attached to a support frame.

With reference to FIGS. 5, 8 and 9, for example, the armrest system 100 includes an armrest mount 102 formed on the outer surface 35 of each of the uprights 20 of the structural frame 12. These armrest mounts 102 may be mirror images of each other, one on the right side of the frame 12 and the other on the left. In one embodiment, the armrest mounts 102 are molded integrally with the structural frame 12 as a unitary piece for efficient manufacturing. The armrest mounts 102 each include a first rail member 114 and a second rail member 116 spaced from the first rail member 114. As illustrated, the rail members 114, 116 extend parallel to one another in a vertical direction along the outer surface 35 of each upright 20. The first rail member 114 includes as base portion 118 and a flange member 120. The base portion 118 extends from the upright 20 and has an inner wall 122 and an outer wall 124. The inner wall 122 faces the second rail member 116 and the outer wall 124 is opposite the inner wall 120. In one embodiment, the flange member 120 extends from the outer wall 124 at the distal end of the base portion 118. The second rail member 116 includes a base portion 128, a flange member 130, and a rack 132. The base portion 128 extends from the upright 120 and includes an inner wall 134 and an outer wall 136. The inner wall 134 faces the inner wall 122 of the first rail member 114. The flange member 130 extends from the outer wall 136 at the distal end of the base portion 128. The rack 132 extends from the inner wall 134 toward the first rail member 114, and includes a series of vertically spaced notches 140.

Figure 12:
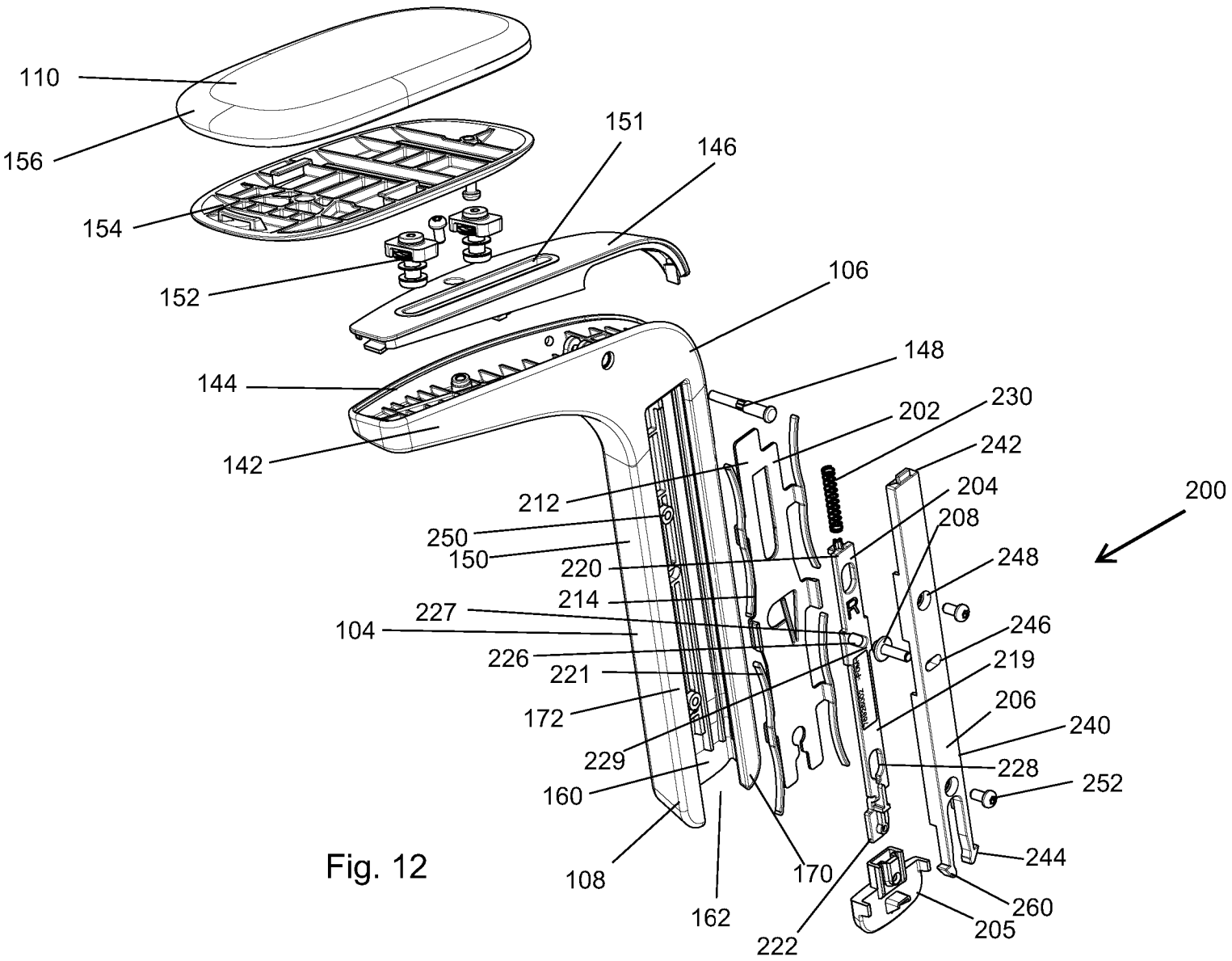
FIG. 12 is an exploded view of an armrest according to one embodiment.
Figure 13:
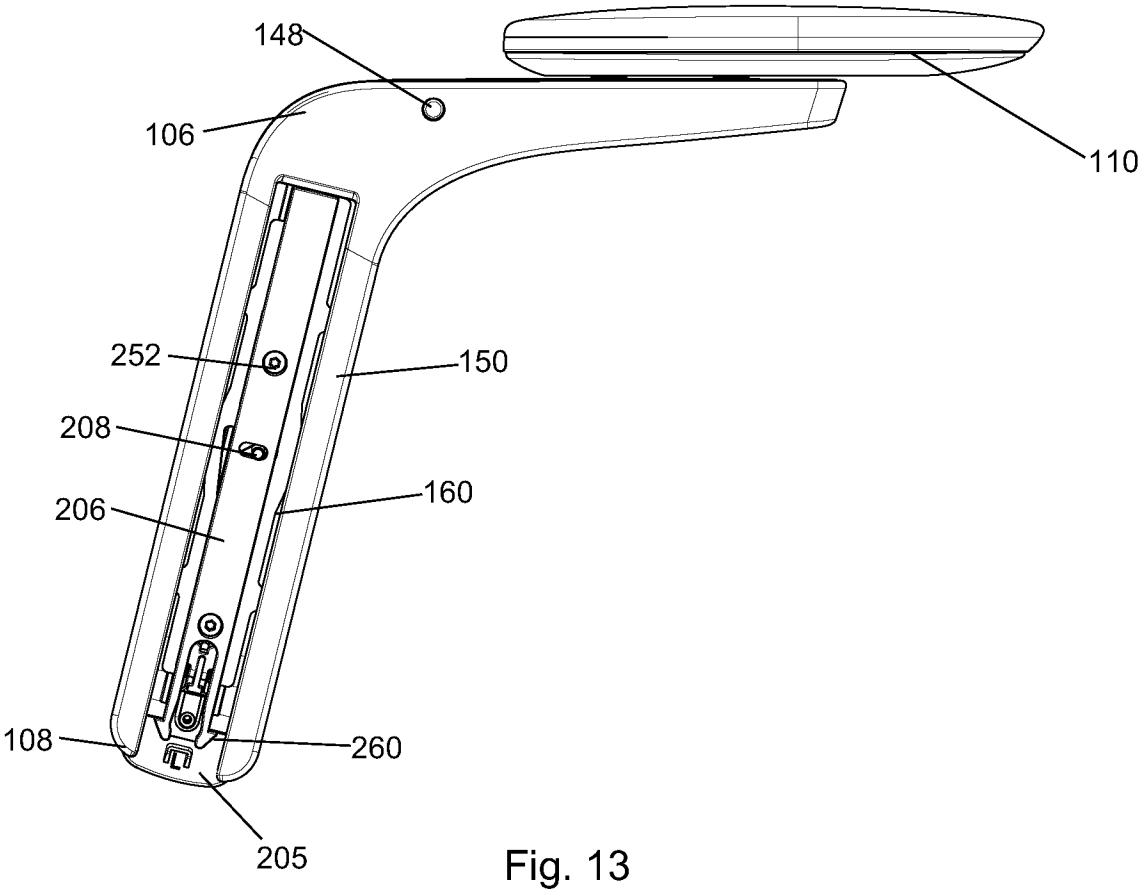
FIG. 13 is a right side view thereof.
Figure 14:
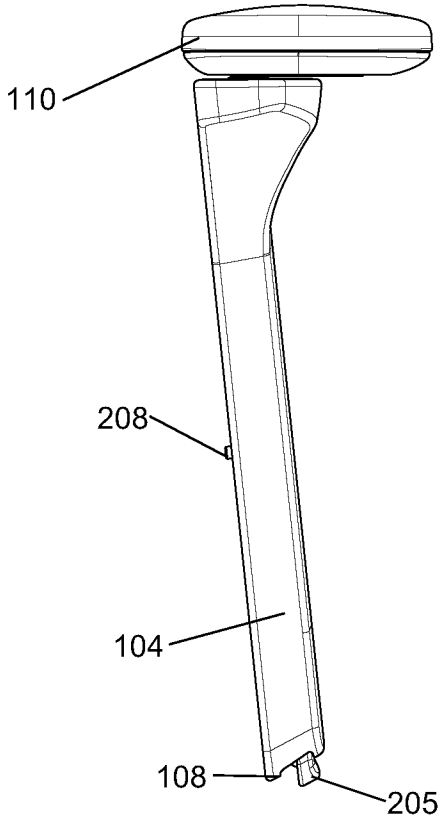
FIG. 14 is a front view thereof.
Figure 15:
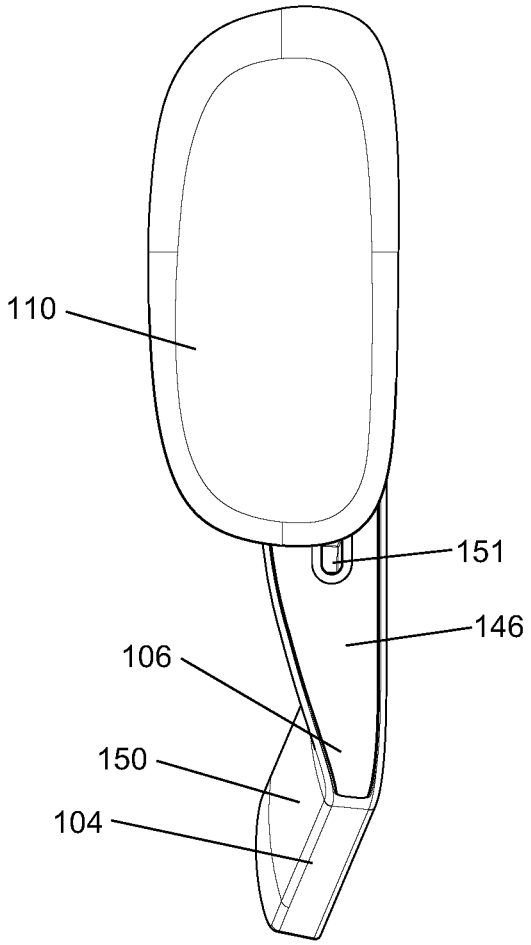
FIG. 15 is a top view thereof.
Figure 16:
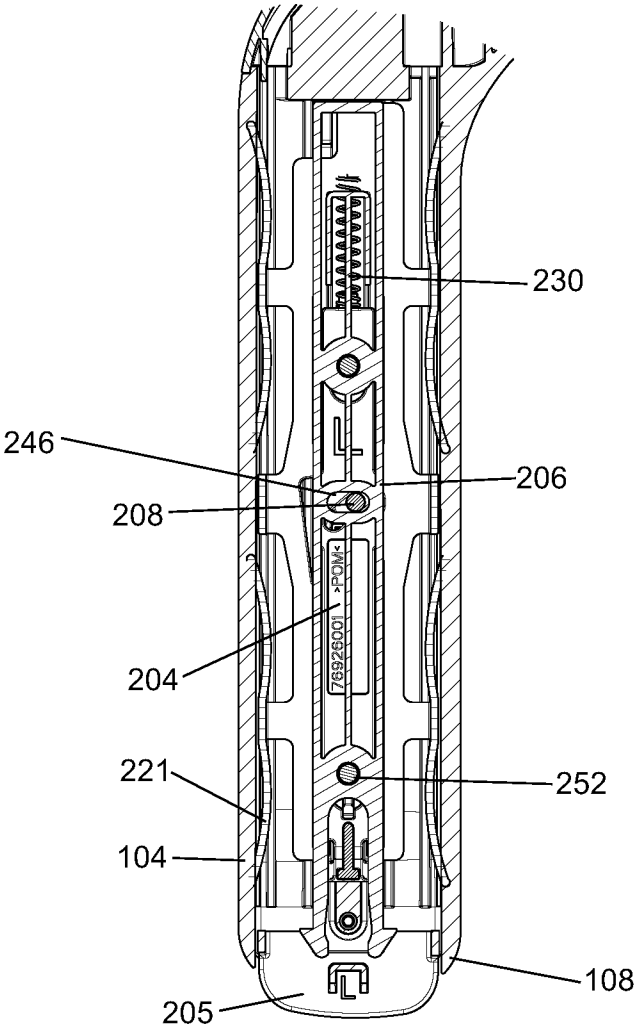
FIG. 16 is a side cross sectional view of a portion of an armrest.
Figure 17:
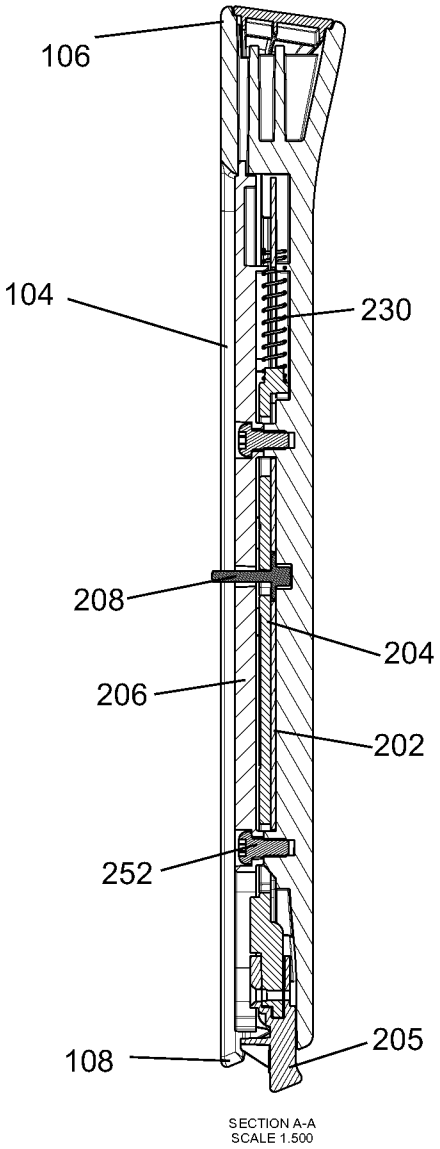
FIG. 17 is a front cross sectional view thereof.
Figure 18:
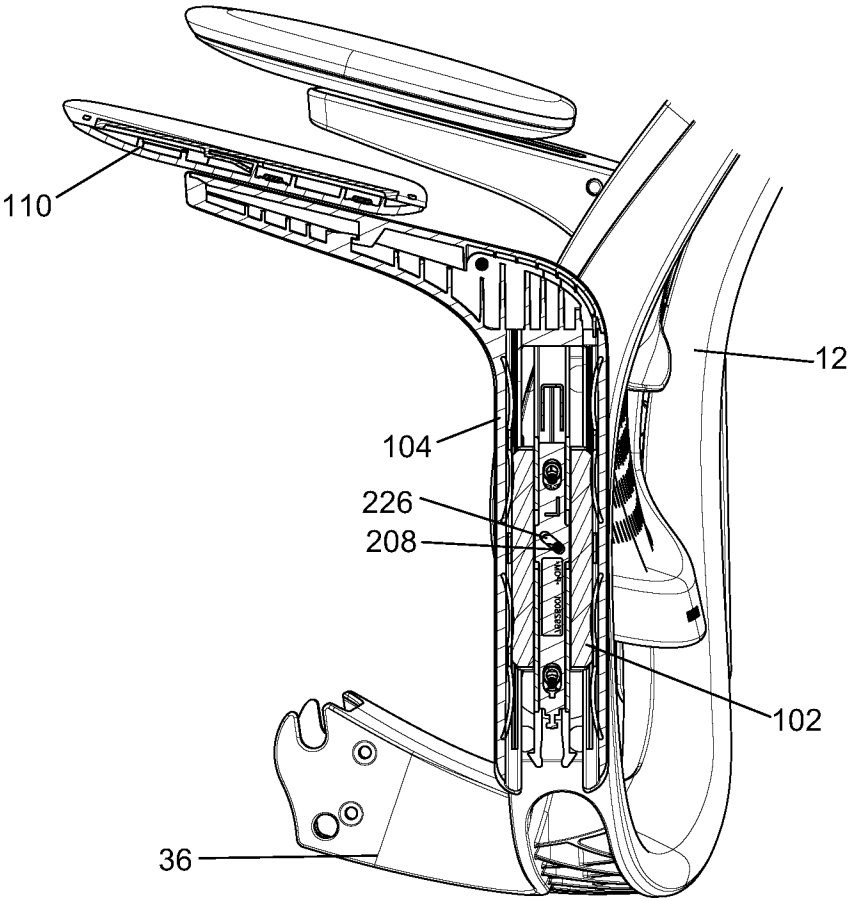
FIG. 18 is a side view of the seat back with an armrest in cross section.

With reference to FIG. 12, the armrest housings 104 are each adjustably mounted to one of the armrest mounts 102. Like the armrest mounts 102, the armrest housings 104 may be mirror images of each other, one on the left side of the frame 12, and the other on the right. As noted, each armrest housing 104 includes an upper end 106 and a lower end 108, the upper end 106 supports the armrest pad 110. In one embodiment, the housing 104 includes an elongated sidewall 150 having a C-shaped cross section. The upper end 106 includes a pad support 142 extending at an angle from the sidewall 150 and including a pair of upwardly extending, spaced apart walls 144. A cover 146 fits over the upper end 106 between the walls 144, and attaches to the armrest housing 104 via an attachment press-fit pin 148 extending through the walls 144 and a portion of the cover 146. In one embodiment, the cover 146 defines a slot 151 extending in a fore-aft direction on the cover 146. The armrest pad 110 horizontally adjustably attaches to the cover 146 via a pair of connectors 152 extending through the pad 110 and the slot 151. More particularly, the pad 110 includes a plate 154 and a cushion 156. The connectors 152 extend through the plate 154 to attach the plate 154 to the cover 146, and the cushion 156 attaches to the plate 154 to form an exposed surface for the user's arms to rest.

The C-shaped sidewall 150 defines an elongated opening 160 extending generally from the upper end 106 to the lower end 108, and a mount insertion opening 162 at the lower end 108. When assembled, the elongated opening 160 faces the armrest mount 102, and the armrest housing 104 attaches to the armrest mount 102 by inserting the first 114 and second 116 rail members into the mount insertion opening 162 and sliding the armrest housing 104 along the first 114 and second 116 rail members with a first rim 170 of the elongated opening 160 engaging the first rail member 114 and with a second rim 172 engaging the second rail member 116 to retain the armrest housing 104 on the rails 114, 116.

Inside the armrest housing 104 is an activation mechanism 200 for selectively locking and unlocking the armrest housing 104 in a desired vertical position along the armrest mount 102. The activation mechanism 200 generally includes an armrest liner 202, an activation plate 204, a retainer plate 206, and a locking pin 208. The armrest liner 202 is positioned within the armrest housing 104 and includes a forward surface 212, and lateral sides 214. The armrest liner 202 is positioned against the armrest housing sidewall 150 with the forward surface 212 facing away from the sidewall 150. In one embodiment, each lateral side 214 includes a pair of leaf springs 221 formed with the armrest liner 202. The leaf springs 221 resiliently engage the first 114 and second 116 rails respectively when the armrest housing 104 is positioned on the armrest mount 102 to take up any tolerances between the armrest housing 104 and the armrest mount 102 and provide the armrest housing 104 with a snug fit on the armrest mount 102.

The activation plate 204 is vertically slidable within the housing 104 to drive the locking pin 208 between locked and unlocked positions. In one embodiment, the activation plate 204 is an elongate plate that is positioned within the housing 104 against the forward surface 212 of the armrest liner 202. The activation plate 204 includes a sidewall 219 having an upper end 220 and a lower end 222, and defines a longitudinal length between the upper 220 and lower 222 ends. An angled slot 226 is defined in the sidewall 219, with the angled slot 226 extending at about a 45 degree angle with respect to the longitudinal length. The angled slot 226 includes an upper end 227 and a lower end 229. In one embodiment, the activation plate 204 also defines a pair of vertical slots 228. When positioned in the armrest housing 104, the upper end 220 of the activation plate 204 is positioned near the upper end 106 of the housing 104 and the lower end 222 of the activation plate 204 is positioned near the lower end 108 of the housing 104 adjacent to the mount insertion opening 162. An activation spring 230 is positioned within the armrest housing 104 between the upper end 106 of the housing 104 and the upper end 220 of the activation plate 204. A button plate 205 attaches to the lower end 222 of the activation plate 204 within the mount insertion opening 162.

The retainer plate 206 is positioned over the activation plate 204 such that the activation plate 204 is sandwiched between the armrest liner 202 and the retainer plate 206. In one embodiment, the retainer plate 206 is fixed in position within the armrest housing 104 such that the activation plate 204 slides with respect to the retainer plate 206. As shown, the retainer plate 206 includes a sidewall 240 having an upper end 242 and a lower end 244. The sidewall 240 defines a horizontal slot 246 that generally aligns with the angled slot 226 of the activation plate 204. The sidewall 204 further defines a pair of mounting holes 248 that align with screw bosses 250 on the housing 104 to enable fixed attachment of the retainer plate 206 to the housing 104 with fasteners 252 extending through the mounting holes 248 on the retainer plate 206, the vertical slots 228 on the activation plate 204, the armrest liner 202, and into the screw bosses 250. A pair of angled prongs 260 extend from the lower end 244 of the retainer plate 206. The angled prongs 260 enable the slidable insertion of the armrest housing 104 onto the armrest mount 102, and once fully inserted, engage the rail members 114, 116 of the armrest mount 102 to retain the housing 104 on the armrest mount 102.

Figure 20:
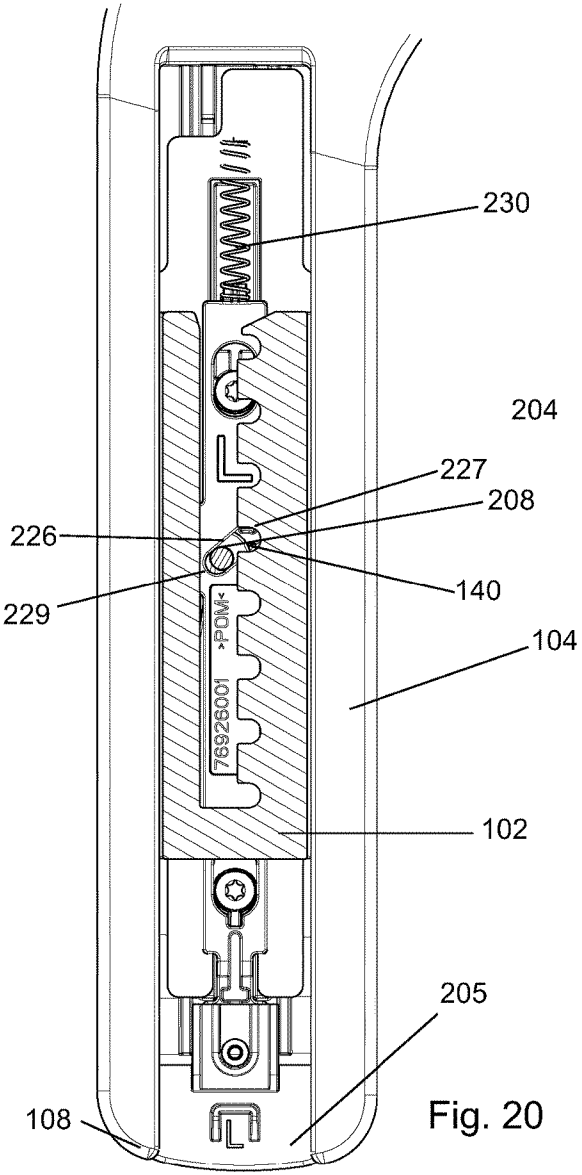
FIG. 20 is a side cross sectional view of an armrest showing the activation mechanism in an unlocked position.
Figure 19:
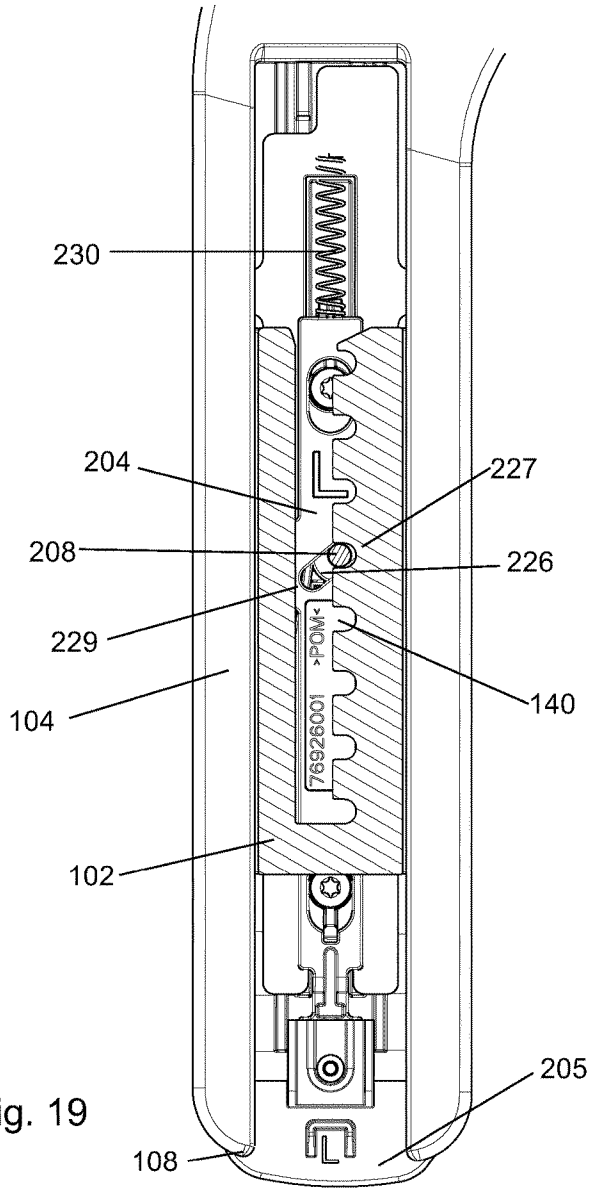
FIG. 19 is a side cross sectional view of an armrest showing the activation mechanism in a locked position.

When the activation mechanism 200 is assembled, the locking pin 208 extends through the angled slot 226 in the activation plate 204 and the horizontal slot 246 in the retainer plate 206. The locking pin 208 may be a bolt or other pin-like member. With reference to FIGS. 19 and 20, the activation mechanism 200 is arranged to move the locking pin 208 between the locked position shown in FIG. 19 and the unlocked position shown in FIG. 20. In the locked position, the button plate 205 is released and the button plate 205 extends downwardly beyond the lower end 108 of the armrest housing 104. The activation plate 204 is in a lowered position and biased in that position by the activation spring 230. The locking pin 208 is driven to the upper end 227 of the angled slot 226 and in this position is moved into engagement with a selected one of the notches 140 in the armrest mount 102. In the unlocked position, the button plate 205 is depressed upwardly, in the direction of the longitudinal length of the activation plate 204, and the activation plate 204 is slid vertically upward, compressing the spring 230. The paths of the horizontal slot 246 on the retainer plate and the angled slot 226 of the activation plate 204 cause the locking pin 208 to move to the lower end 229 of the angled slot 226 and therefore out of engagement with any of the notches 140 to enable the armrest housing 104 to slide freely with respect to the armrest mount 102 to a desired vertical position.

Figure 10:
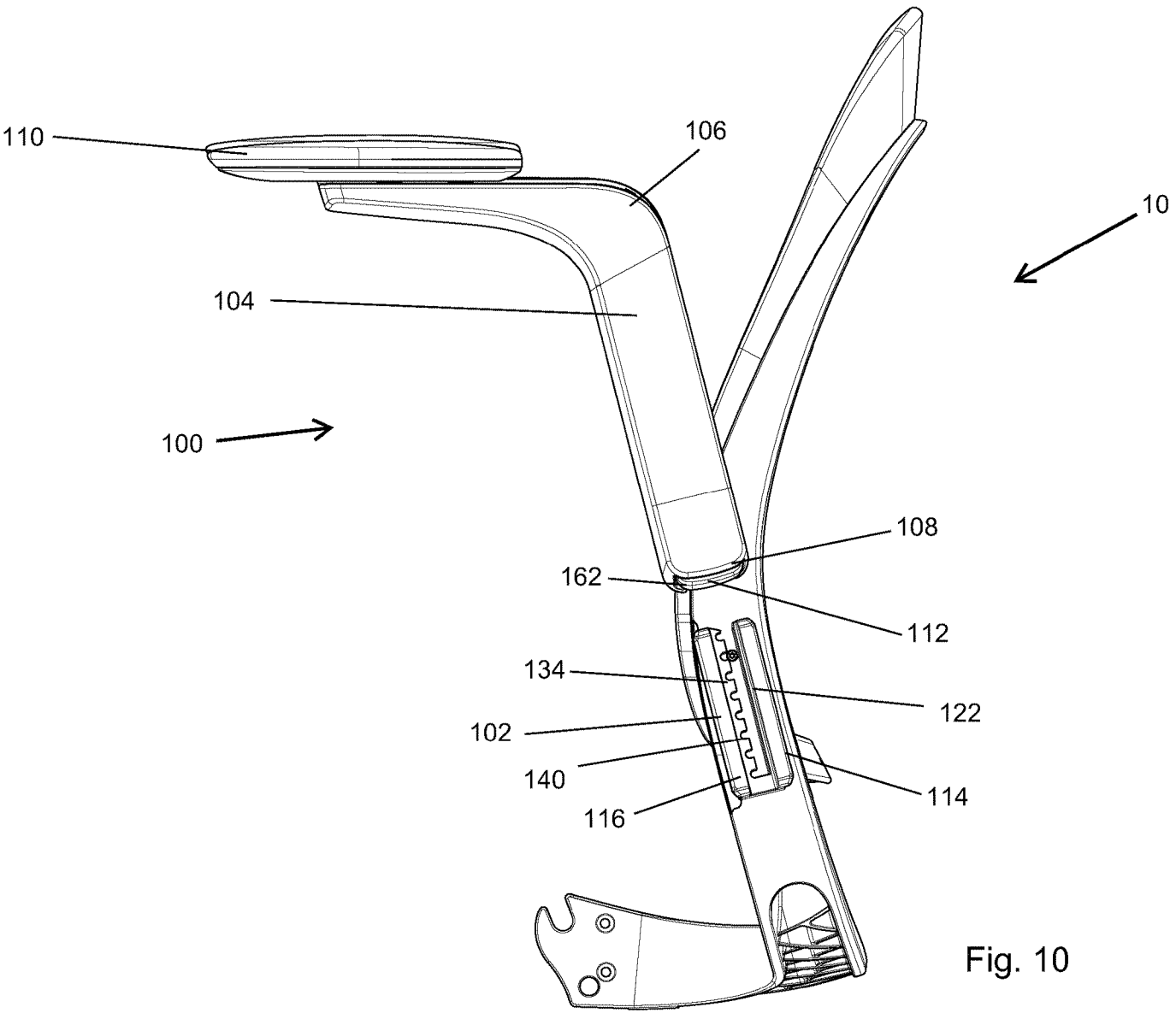
FIG. 10 is a side view of the seat back with armrests unattached according to one embodiment.
Figure 11:
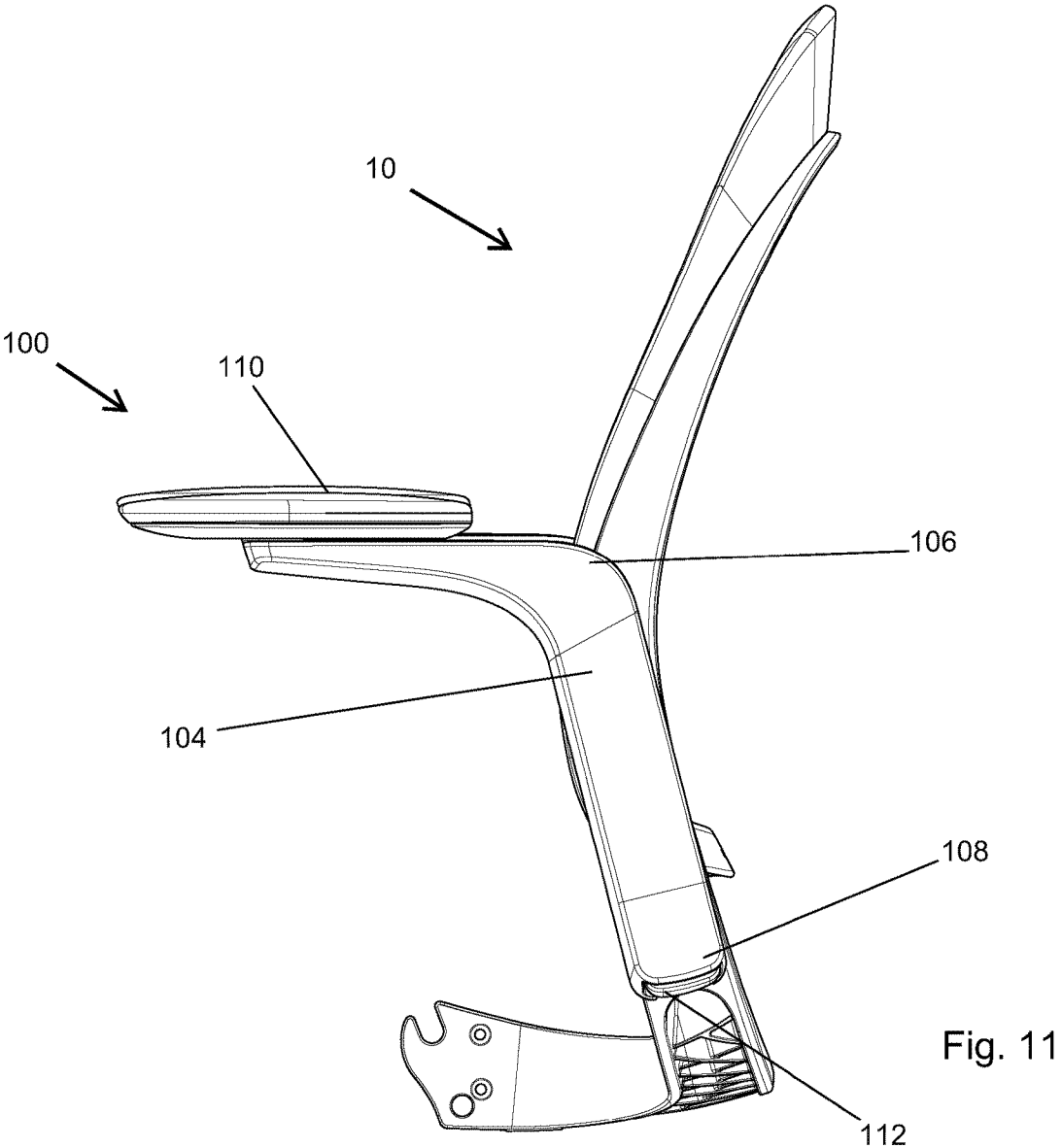
FIG. 11 is a side view of the seat back according to one embodiment.

Assembly of the armrest system 100 includes positioning one of the armrest housings 104 vertically above one of the armrest mounts 102, noting that the appropriate right hand or left hand armrest housing 104 would be positioned above the associated right side or left side upright 20 of the structural frame 12. With reference to FIG. 10, a left handed armrest housing 104 is positioned above the armrest mount 102 on the left upright 20, with the mount insertion opening 162 of the armrest housing 104 positioned above the rails 114, 116 of the armrest mount 102 and the elongated opening 160 facing the upright 20. The armrest housing 104 is then slid onto the armrest mount 102 by inserting the rails 114, 116 into the armrest insertion opening 162 and sliding the armrest housing 104 down onto the armrest mount 102. The angled prongs 260 on the retainer plate 206 flex upon insertion between the rails 114, 116, and the retainer plate 206 is slid between the rails 114, 116 until the prongs 260 slide past the rails 114, 116 and release. The button plate 205 may be attached to the activation plate 204 before or after the housing 104 has been slid onto the rails 114, 116. The leaf springs 221 of the armrest sleeve 202 engage the rails 114, 116 to resiliently take up any slack between the armrest housing 104 and the armrest mount 102. With the armrest housing 104 positioned on the armrest mount 102, the armrest system 100 enables adjustment of the height of the armrest housing 104 (and thus the armrest pad 110) by the user activating or releasing the activation mechanism 200. As noted above, when the button plate 205 of the activation mechanism 200 is released (i.e., not depressed by the user) the locking pin 208 is driven to the upper end 227 of the angled slot 226 and will extend into the nearest notch 140 as the armrest housing 104 is adjusted past the notch 140. As long as the button plate 205 is not depressed, the pin 208 will be engaged in the notch 140 and the armrest housing 104 will be prevented from vertical movement. When the user presses the button plate 205 in an upward direction, the activation plate 204 is slid vertically along the retainer plate 206 and the pin 208 is driven to the lower end 229 of the angled slot 226, disengaging the pin 208 from the notches 140 and allowing vertical movement of the armrest housing 104 along the armrest mount 102 until the button plate 205 is released, the pin 208 slides back to the upper end of the angled slot 226 and into one of the notches 140.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A seat back for an office chair, comprising:
   - a structural frame having a pair of spaced apart upright members each having an upper end and a lower end, and an upper cross member connecting the upper ends of the uprights;
   - a flexible support including a user support surface having an upper edge, a lower edge, and a pair of side edges, the upper edge of the flexible support mounted on the upper cross member of the frame; and
   - a tensioner connected between the lower edge of the flexible support and the upright members of the frame such that the tensioner stretches the flexible support between the upper and lower edges of the flexible support and maintains the flexible support in tension on the structural frame, wherein the tensioner includes at least one tensioner arm, the at least one tensioner arm having a first end including structure that enables the at least one tensioner arm to pivotally engage with at least one of the upright members at a tensioner mount that is positioned between the upper and lower end of the one of the upright members, the at least one tensioner arm including a second end spaced from the first end and attached to the lower edge of the flexible support, wherein the at least one tensioner arm is pivotable between a first position and an installed position, and wherein the flexible support has a first unstretched length between the upper and lower edges when the at least one tensioner arm is in the first position and a second stretched length that is greater than the first length when the at least one tensioner arm is in the installed position.

2. The seat back of claim 1 wherein the upright members each include one of the tensioner mounts positioned between the upper and lower end, the tensioner connected between the lower edge of the flexible support and the tensioner mounts.

3. The seat back of claim 2 wherein the tensioner includes a base and a pair of the tensioner arms extending from the base, the base extending along the lower edge of the flexible support, the arms each extending along one of the side edges.

4. The seat back of claim 3 wherein each of the tensioner arms includes an end connected to an associated one of the tensioner mounts.

5. The seat back of claim 4 wherein the upper edge of the flexible support defines a pocket, the pocket extending over at least a portion of the upper cross member of the frame to mount the upper edge of the flexible support to the frame.

6. A seat back for an office chair, comprising:
   - a structural frame having an upright member;
   - an armrest mount formed integrally with the upright member;
   - an armrest housing vertically adjustably mounted to the armrest mount, the armrest housing having an upper end and a lower end and defining a longitudinal axis extending through the upper and lower ends;
   - an armrest pad mounted on the upper end;
   - an activation mechanism within the housing, the activation mechanism including a lock element that is movable between a locked position in which the housing is fixed in position on the armrest mount and an unlocked position in which the housing is vertically adjustable by sliding along the armrest mount; and an activation portion of the activation mechanism positioned adjacent to the lower end of the housing, the activation portion connected to the lock element such that movement of the activation portion toward the upper end of the housing causes the lock element to move to the unlocked position, wherein the movement of the activation portion and the sliding movement of the armrest housing are aligned along the longitudinal axis.

7. The seat back of claim 6 wherein the activation portion extends at least partially into the armrest.

8. The seat back of claim 7 wherein the armrest mount includes a plurality of vertically spaced notches, the lock element positioned in one of the notches when the lock element is in the locked position.

9. The seat back of claim 8 wherein the armrest mount includes opposing rails and the plurality of vertically spaced notches are defined in one of the opposing rails.

10. The seat back of claim 8 wherein the armrest mount is molded integrally with the side edge of the backrest.

11. A seat back for an office chair, comprising:

a structural frame having an upright member;

an armrest mount formed integrally with the upright member;

an armrest housing vertically adjustably mounted to the armrest mount, the armrest housing having an upper end and a lower end;

an armrest pad mounted on the upper end;

an activation mechanism within the housing, the activation mechanism including a lock element that is movable between a locked position in which the housing is fixed in position on the armrest mount and an unlocked position in which the housing is vertically adjustable along the armrest mount; and an activation portion of the activation mechanism positioned adjacent to the lower end of the housing, the activation portion connected to the lock element such that movement of the activation portion toward the upper end of the housing causes the lock element to move to the unlocked position, wherein the lock element is a pin, and the activation mechanism includes an activation plate that is movable with respect to a retainer plate, wherein the pin extends through an activation slot in the activation plate and a horizontal slot in the retainer plate, the activation slot being angled with respect to the horizontal slot.

12. The seat back of claim 11 including a tolerance spring within the housing, the tolerance spring interfitted between the housing and at least one of the rails of the armrest mount to bias the housing against the at least one of the rails.

13. The seat back of claim 12 wherein the lower end of the housing defines an opening, and wherein the activation portion includes a button positioned within the opening, the button connected to the lock element such that pressing the button toward the upper end of the housing moves the lock element to the unlocked position.

14. The seat back of claim 13 including an activation spring within the housing, the activation spring biasing the button in a direction away from the upper end of the housing.

15. The seat back of claim 14 wherein the frame includes a pair of the upright members spaced apart from each other, each of the upright members including an upper end and a lower end, the frame including a lower cross member connecting the lower ends of the uprights and an upper cross member connecting the upper ends.

16. The seat back of claim 15 including a flexible support, the flexible support including a user support surface having an upper edge, a lower edge, and a pair of side edges, the upper edge of the flexible support mounted on the upper cross member of the frame, the seat back including a tensioner connected between the lower edge of the flexible support and the upright members of the frame such that the tensioner stretches the flexible support between the upper and lower edges of the flexible support and maintains the flexible support in tension on the frame.

17. A method for constructing a seat back, comprising the steps of:

providing a flexible support including a user support surface having an upper edge, a lower edge, and a pair of side edges;

providing a structural frame having a pair of spaced apart upright members each having an upper end and a lower end, a lower cross member connecting the lower ends of the uprights, and an upper cross member connecting the upper ends of the uprights;

providing a tensioner arm having a first and a second end;

attaching the first end of the tensioner arm to the lower edge of the flexible support;

mounting the upper edge of the flexible support to the upper cross member of the structural frame;

engaging the second end of the tensioner arm with one of the upright members of the structural frame; and pivoting the tensioner arm about the second end of the tensioner arm to draw the first end of the tensioner arm to the structural frame as the tensioner arm acts to stretch the flexible support between the upper and lower edges of the flexible support.

18. The method of claim 17 including extending a fastener through the structural frame and the tensioner arm to hold the tensioner arm in position with respect to the structural frame.

19. The method of claim 18 wherein a pair of the tensioner arms are connected to one another by a tensioner base, the tensioner base connected along the lower edge of the flexible support, the tensioner arms each extending along one of the uprights of the structural frame.

20. The method of claim 19 including an abutment projection provided on at least one of the tensioner arms, the abutment projection extending from the second end of the tensioner arm and abutting the one of the uprights of the structural frame.

* * * * *